US006498281B1

(12) United States Patent
Lupton

(10) Patent No.: US 6,498,281 B1
(45) **Date of Patent: *Dec. 24, 2002**

(54) TREATMENT OF CHEMICAL HYDROLYSATES

(75) Inventor: Francis Stephen Lupton, Evanston, IL (US)

(73) Assignee: Honeywell International Inc., Morristown, NJ (US)

( * ) Notice: Subject to any disclaimer, the term of this patent is extended or adjusted under 35 U.S.C. 154(b) by 35 days.

This patent is subject to a terminal disclaimer.

(21) Appl. No.: 09/632,463

(22) Filed: Aug. 4, 2000

Related U.S. Application Data

(60) Provisional application No. 60/147,946, filed on Aug. 6, 1999.

(51) Int. Cl.[7] ..... A62D 3/00

(52) U.S. Cl. ..... 588/200; 588/202; 588/203

(58) Field of Search ..... 588/200, 202, 588/203; 435/262.5

(56) References Cited

U.S. PATENT DOCUMENTS

| | | | | |
|---|---|---|---|---|
| 5,370,845 | A | | 12/1994 | Miller |
| 5,498,401 | A | | 3/1996 | Johnson |
| 5,574,202 | A | | 11/1996 | Pilipski |
| 5,584,071 | A | | 12/1996 | Kalyon |
| 5,710,358 | A | | 1/1998 | Yang |
| 5,711,020 | A | | 1/1998 | Wolfe |
| 6,080,906 | A | * | 6/2000 | Johnson et al. ..... 588/200 |

* cited by examiner

*Primary Examiner*—Stanley S. Silverman
*Assistant Examiner*—Eileen E. Nave

(57) ABSTRACT

A chemical munition hydrolysate treatment system pretreats agent hydrolysate with irradiation in the presence of an oxidant and processes the pre-treated chemical agent and energetic materials through a series of treatment processes until a preselected level of destruction is achieved. The treatment process includes a biological treatment of the aqueous wastestreams and catalytic oxidation of the air exhaust streams.

24 Claims, 1 Drawing Sheet

TREATMENT OF CHEMICAL HYDROLYSATES

RELATED APPLICATIONS

The present application is based on co-pending U.S. Provisional Application No. 60/147,946, filed Aug. 6, 1999, which is incorporated herein by reference.

BACKGROUND OF THE INVENTION

1. Field of the Invention

This invention relates to a process and a system for destruction of hydrolysates, and particularly aqueous hydrolysates generated from the demilitarization of chemical munitions.

2. Description of the Prior Art

The destruction of chemical munitions is a major international concern. International treaties now outlaw these weapons, and their safe disposal has been mandated.

Disposal of chemical weapons is conventionally effected by means of incineration. Although incineration represents a technically feasible approach to the destruction of these materials, it is not only unacceptable to many state and local governments, but it is also unacceptable to many of the communities surrounding the stockpile sites. One of the major concerns of these groups is the perceived hazards to the environment associated with emissions from incinerators. There is a great desire on the part of all the stakeholders of the chemical munitions demilitarization process to find effective, safe and cost efficient alternative technologies for the destruction of these weapons.

Neutralization of the chemical agent and the energetic components of chemical munitions by hydrolysis in a strong base solution is an accepted alternative technology to incineration, but the treatment of the resulting hydrolysate is problematic because the hydrolysis products could be used to reform the chemical agent and thus must be further treated. Biological treatment processes are known to be able to successfully treat energetic hydrolysates as well as hydrolysates of mustard agent (H) but biological treatment of nerve agent (VX & GB) hydrolysates has proven difficult due to the low biodegradability of the carbon-phosphorous bond of the alkyl phosphonate component of these hydrolysates. For this reason, biological treatment of nerve agent hydrolysates in combination with energetic hydrolysates is not generally accepted as practicable. See *Alternative Technologies for the Destruction of Chemical Agents and Munitions*, NRC, which is incorporated in its entirety by reference, at p.126–136.

SUMMARY OF THE INVENTION

The present invention provides systems and methods that use a unique combination of oxidation, preferably UV/oxidation, followed by organic removal, preferably by biological treatment, to process chemical and energetic hydrolysates to achieve results that heretofore have not been attainable. The preferred processes comprise: (1) oxidizing a chemical hydrolysate, and preferably a hydrolysate comprising alkyl phosphonate, to produce a treated chemical hydrolysate containing organic compounds; (2) optionally combining the treated chemical agent hydrolysate with an energetics hydrolysate; and (3) removing at least a portion of the organic compounds contained in said treated hydrolysate by exposing said treated hydrolysate to biodegradation. The oxidizing step preferably comprises irradiating the chemical hydrolysate, preferably with ultraviolet (UV) radiation in the presence of an oxidant.

The present inventor has found that processes according to this invention are capable of achieving surprisingly and unexpectedly superior results when compared to the processes of the prior art. For example, the methods of the present invention are capable of removing alkyl phosphonates, a component found in many chemical agent hydrolysates, at a 90% or greater efficiency.

BRIEF DESCRIPTION OF THE DRAWINGS

The invention will be more fully understood and further advantages will become apparent when reference is had to the following detailed description and the accompanying drawing in which.

DESCRIPTION OF PREFERRED EMBODIMENTS

Figure 1:
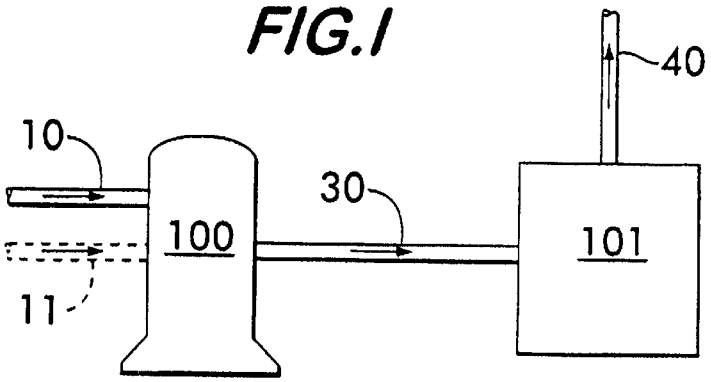
FIG. 1 is a block process flow diagram of a hydrolysate disposal system according to one embodiment of the present invention.

A generalized block flow diagram according to one broad embodiment of the present invention is provided in FIG. 1. According to this embodiment, chemical agent hydrolysate is introduced, preferably via stream 10, to a reactor 100 wherein the hydrolysate is exposed to oxidative conditions to produce a treated chemical hydrolysate stream 30 in which at least a portion, and preferably a substantial portion, of the hydrolysate has been oxidized. It will be appreciated that the reactor 100 may comprise a single vessel, a plurality of vessels (each of which may be the same or different) in a parallel and/or series configuration. In addition, it is apparent that other feed streams and/or product streams may be associated with the reactor 100. For example, in certain embodiments, the oxidating agent may be introduced into the reactor 100 by stream 11, for example. The treated chemical hydrolysate which is contained in stream 30 is preferably introduced into a bioreactor 101 to produce at least one reactor effluent 40 containing a reduced level of organic compounds which is reduced, and preferably substantially reduced, relative to the feeds to the bioreactor. As with the reactor 100, it will be appreciated that reactor 101 may comprise a single vessel or a plurality of vessels of the same or different types connected in series and/or parallel arrangements.

Numerous types of chemical agents can be treated by the methods and with the systems of the present invention, as will be apparent to those skilled in the art based on the present teachings. For example, chemical munitions destruction systems typically involvedisassembling the weapon to expose the chemical agent contained therein. Such destruction systems are disclosed in co-pending U.S. patent application Ser. No. 09/152,431, which is incorporated herein by reference. All such chemical agents can be treated in accordance with the present invention. Furthermore, chemical agents which can be treated in accordance with the present invention include any of the highly toxic chemicals that have been stockpiled for use in warfare. Specific examples of chemical agents that can be advantageously treated in accordance with the present invention include, but are not limited to: nerve agents such as GA (Tabun), GB (Sarin), GD (Soman), and VX; and blister agents such as HD (distilled mustard), H, HT, nitrogen mustards (HN-1, HN-2, HN-3), and Lewisites (1, 2, and 3).

Likewise, numerous types and varieties of energetic materials can be treated in accordance with the present invention. Such energetic materials include any of those which are used for explosive or propellant purposes. Energetic materials which can be advantageously treated by the present methods and systems include, but are not limited to: TNT, RDX, HMX, Tetryl, Lead Azide, nitrocellulose, nitroglycerine, triacetin, dimethylphthalate, lead stearate, 2-nitrodiphenylamine, and combination energetic materials, including Tetrytol, Comp B and B-4, Comp A-5, M-28 double-base propellant, and Propellants AXIS, NH, WIS 1212 and CYH.

An important aspect of the present invention is the treatment of the hydrolysate of chemical agents. According to certain embodiments, the present methods include the step of treating a chemical agent to produce a chemical agent hydrolysate. In certain embodiments, it is preferred that the step of treating the chemical agent consists essentially of converting the chemical agent to chemical agent hydrolysate. Any such treating or converting step is within the scope hereof, including the preferred the step of neutralizing the chemical agent. Preferred neutralization steps include dissolving the chemical agent in solvent, preferably a polar solvent such as water. For such steps, the solvent is preferably an aqueous solution with a basic pH, with an aqueous base comprising sodium hydroxide being especially preferred. In particular embodiments, the treating or converting step comprises dissolving the chemical agent in an aqueous solution containing about 4% sodium hydroxide at a temperature of about 90° C., preferably for a period of from about 4 to about 12 hours. This preferred dissolving step can be conducted according to any of the means or steps known in the art, including charging the materials to any Inconel, stainless steel or polymer lined carbon steel reactor such as those available from Fodler.

It will be appreciated that although certain preferred embodiments of the present invention include the step of converting the chemical agent to chemical agent hydrolysate, the present invention broadly encompasses methods in which the hydrolysate is simply provided to the process.

As mentioned above, an important aspect of the present invention involves the step of oxidizing the chemical agent hydrolysate, preferably by exposure to an oxidant and to radiation. It is contemplated that the preferred steps can be conducted by sequentially exposing the chemical agent hydrolysate to the oxidant, preferably by combining the oxidant with the hydrolysate and then exposing the combination of hydrolysate and oxidant to UV radiation, preferably in a UV reactor. In other embodiments, the hydrolysate is exposed to the oxidant and the radiation substantially simultaneously, as would occur, for example, by introducing hydrolysate to a UV reactor and introducing the oxidant to the hydrolysate via a separate feed to the reactor. According to preferred embodiments, the pretreatment of the chemical hydrolysate can be conducted in a Rayox UV reactor manufactured by Calgon Oxidation Systems, a subsidiary of Calgon Corporation.

Figure 2:
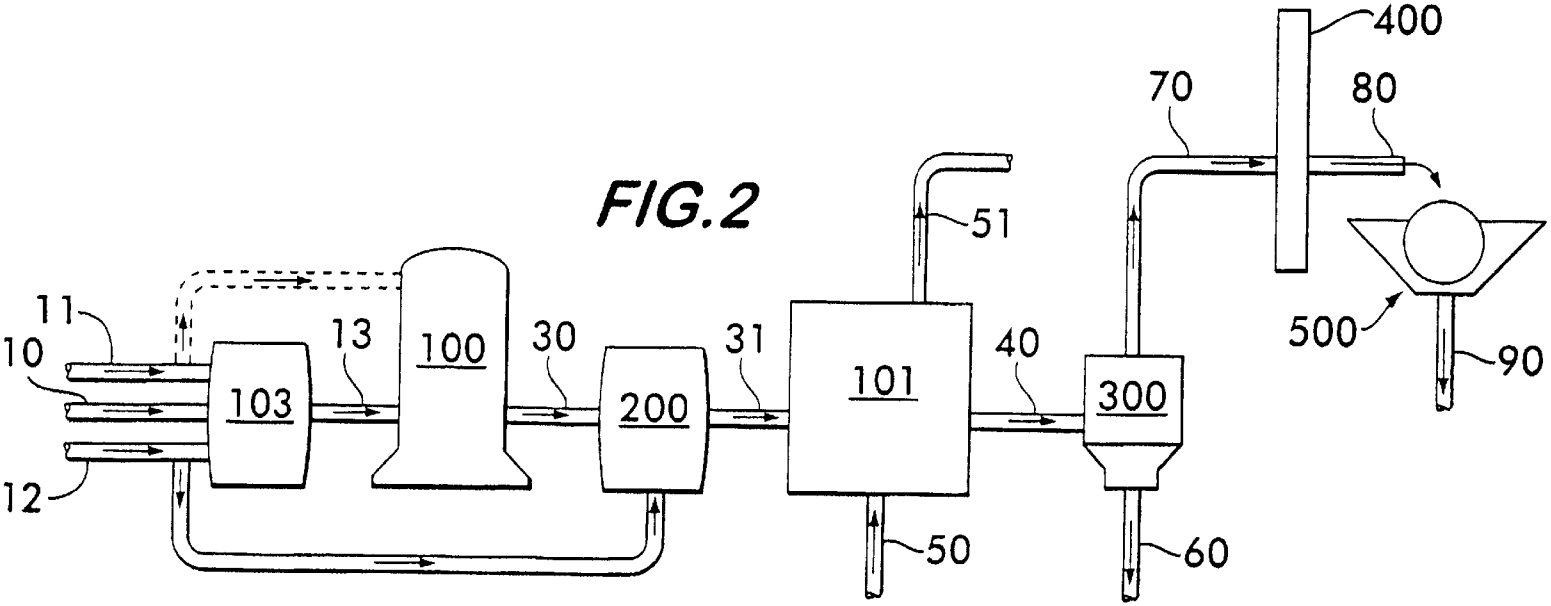
FIG. 2 is a block process flow diagram of a particular hydrolysate disposal system in accordance with a more particular embodiment of the type illustrated more generally in FIG. 1.

FIG. 2 illustrates preferred embodiments of the present invention in which the chemical hydrolysate is diluted with water before it is fed to the reactor, for example by introducing dilution water 12 and hydrolysate 10 into a mixing means 103. The weight ratio of chemical hydrolysate to water preferably is from about 1:10 to about 1:1000, more preferably from about 1:50 to about 1:500 and even more preferably from about 1:100 to about 1:200.

As mentioned above, the oxidant can be added directly to the hydrolysate, for example as a stream 11 introduced to the mixing means 103, and/or as a separate feed 11 to the irradiation reactor 100. Any oxidant that can be excited by radiation, and preferably UV 20 radiation, may be used in-the process. Suitable oxidants include but are not limited to hydrogen peroxide, ozone, sodium persulfate, and sodium meta-periodate. Hydrogen peroxide and ozone are preferred, with hydrogen peroxide being most preferred.

For the preferred embodiments in which the chemical hydrolysate comprises an alkyl phosphonate, the mole ratio of oxidant to alkyl phosphonate (in the chemical agent being oxidized) is preferably from about 5:1 to about 1:1, more preferably from about 4:1 to about 2:1, and even more preferably from about 3.5:1 to about 2.5:1.

It will be appreciated that the amount of radiation used to irradiate the chemical agent hydrolysate in accordance with the present invention can vary depending upon numerous factors, including the particular nature of the chemical agent hydrolysate, the desired degree of oxidation, the particular oxidant used, and the like. All such levels of exposure are within the scope hereof and can be determined for any particular case without undue experimentation in view of the information contained herein. According to preferred embodiments, the hydrolysate is exposed to UV radiation in an amount of from about 190 to about 390 NM, more preferably from about 200 NM to about 300 NM and even more preferably from about 200 NM and about 240 NM.

The reactor loading and exposure period can likewise vary in accordance with the present invention. For embodiments in which chemical agent hydrolysate comprises alkyl phosphonate and in which the exposure step includes introducing the hydrolysate to a UV reactor, the loading in the reactor is preferably from about 0.1 to about 1.0 gram of alkyl phosphonate/kW lamp power, more preferably from about 0.2 to about 0.5 gram of alkyl phosphonate/kW lamp power, and even more preferably from about 0.21 and about 0.29 gram of alkyl phosphonate/kW lamp power. The period of exposure to UV radiation is preferably from about 2 to about 12 hours, more preferably from about 4 to about 10 hours and most preferably from about 6 to about 8 hours.

Once a chemical agent hydrolysate has been exposed to radiation and to the oxidant to produce treated chemical agent hydrolysate, at least a portion of the organic contained in the treated chemical hydrolysate is removed, preferably by biological treatment. For such preferred embodiments, any known biological treatment step which is known to degrade organic compounds may be used. Particularly preferred are those biological treatment steps which are capable of degrading the volatile organic compounds (VOCs) and semi-volatile compounds (SVOCs) associated with these hydrolysates. The step of removing organic compounds from the treated hydrolysate preferably includes introducing the treated hydrolysate to an immobilized cell bioreactor (ICB) system. Such systems are available from Honeywell (formerly AlliedSignal Inc. of Morristown, N.J.) and are described in U.S. Pat. No. 5,217,616, which is incorporated herein by reference. According to certain preferred embodiments, as illustrated in FIG. 2, the treated hydrolysate stream 30 is introduced to a second mixing means 200, together with dilution water 12, to produce a diluted, treated hydrolysate 31 which is introduced to a bioreactor 101. When this step is used, the additional water is preferably added in an amount sufficient to facilitate the removal of organics, which is preferably so as to produce a treated hydrolysate:water ratio of from about 1:10 to about 1:1000, more preferably from about 1:50 to about 1:500, and even more preferably from about 1:100 to about 1:200.

Other biological treatment steps that can be used include treating the oxidized hydrolysate with activated sludge and/ or introducing the oxidized hydrolysate to a sequencing batch reactor. Furthermore, it is contemplated that the step of removing the organics from the oxidized hydrolysate can include a combination of one or more of these biologic treatment steps so as to degrade at least a portion of the organic compounds, and preferably substantially all of the organic compounds, including the VOCs and SVOCs, present in the treated hydrolysate.

For embodiments in which the dilution step is used and in which the removal step comprises biodegrading the treated chemical agent hydrolysate in a bioreactor, and particularly an ICB reactor, the hydraulic residence time of the diluted hydrolysate within the reactor system is preferably from about 1 day to about 10 days, more preferably from about 2 days to about 8 days and even more preferably from about 4 and about 6 days. For bioreactor embodiments, the aeration of the bioreactor preferably includes blowing an oxygen containing stream 50 (e.g., air) into the bioreactor to provide oxygen for the bacteria. In such embodiments, the air flow rate is preferably in the range of from about 800 scfm to about 1,600 scfm of air per pound of total organic carbon load, more preferably from about 1,000 and about 1,400 scfm air per pound of total organic carbon load, and even more preferably from about 1,100 to about 1,300 scfm air per pound of total organic carbon load. For embodiments which comprise use of an ICB, the reactor feed 31 is preferably maintained at a pH of from about 5.5 to about 9.5, more preferably from about 6.5 to about 8.5, and even more preferably from about 7.0 to about 8.0.

The effluent stream 40 from the biological treatment step is generally sent to a clarification system 60 that will produce sludge 60 suitable for dewatering and a clear effluent stream 70, which is suitable for evaporation in evaporator 70 to produce brine 80. The brine 80 is dried in a dryer 500 to produce a salt cake 90. The sludge and brine or salt cake produced from this process is preferably tested and then disposed of in accordance with all local, state and federal regulations.

Vent gases 51 from the biological treatment step can be treated by catalytic oxidation in order to remove those trace contaminants in the gas amenable to oxidation, including organic compounds containing phosphorus, sulfur, or chlorine, and chemical agents.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

About 0.1 ml of hydrolysate of VX nerve agent is diluted in about 20 ml of water. Three and one half tenths (0.35) of a milliliter of a 30% solution of hydrogen peroxide is added to the diluted hydrolysate in a 25 ml quartz cuvette. The diluted VX hydrolysate containing hydrogen peroxide is exposed to UV radiation by inserting a UVP Pen-Ray lamp into the curette. The power supply to the lamp is a UVP Pen Ray Power supply (115V, 60 Hz, 0.41 amp). The cuvette is exposed to UV radiation at 200 NM–250 NM for a total of 4 hours, in 20-minute intervals. The removal of total alkyl phosphonates is measured using the HACH phosphonate test (HACH method #8501) and is reported in Table 1 below.

TABLE 1

| Total Alkyl Phosphonates (mg/L) | |
|---|---|
| Untreated Diluted VX Hydrolysate | UV/Peroxide Treated Diluted VX Hydrolysate |
| 1,400 | 5 |

EXAMPLE 2

About 5 ml of the treated hydrolysate from Example 1 is combined with about 10 ml of (energetic) hydrolysate and diluted with about 200 ml of water to produce a treated chemical hydrolysate stream. This stream, in the form of an aqueous solution, is fed to a 1,000 ml bench top immobilized cell bioreactor consisting of a glass vessel of 1 liter volume (3" wide by 10" high) containing 650 ml of mixed foam packing ½ inch squares and plastic pall ring cylinders ½ inch long and wide. Air is introduced into the reactor by means of a glass frit at the bottom of the bed. Water enters the bottom of the reactor through a port and exits the reactor through the top of the reactor via another port. The liquid volume introduced into the reactor is about 700 ml over a 24-hour period by means of a peristaltic pump. The bioreactor is aerated at a rate of 200 ml/min. The removal of Chemical Oxygen Demand (COD), a measure of the amount of total organics present, is determined and is reported in Table 2 below.

TABLE 2

| Chemical Oxygen Demand (mg/L) | |
|---|---|
| Combined agent and energetic Feed | Bioreactor Effluent |
| 4,100 | 406 |

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for the treatment of chemical agent hydrolysates and energetic hydrolysates comprising:

(a) oxidizing an chemical agent hydrolysate by exposing the chemical agent hydrolysate to an oxidant and to UV radiation to produce a treated chemical agent hydrolysate containing organic compounds;

(b) combining at least a portion of said treated chemical agent hydrolysate and at least a portion of the energetic hydrolysate to form a combined hydrolysate; and (c) removing from said combined hydrolysate at least a portion of the organic compounds present in said combined hydrolysate.

2. The process of claim 1 wherein said removing step comprises biologically treating said combined hydrolysate to remove at least a portion of the organic compounds present in said combined hydrolysate.

3. The process of claim 2 wherein said step of biologically treating said combined hydrolysate comprises introducing at least a portion of said combined hydrolysate to a bioreactor.

4. The process of claim 1 wherein said chemical agent hydrolysate comprises nerve agent.

5. The process of claim 4 wherein said nerve agent comprises at least one selected from the group consisting of GA, GB, GD and VX.

6. The process of claim 1 wherein said chemical agent hydrolysate comprises a blister agent.

7. The process of claim 6 wherein said blister agent comprises at least one selected from the group consisting of HD, H, HT, HN-1, HN-2, HN-3, lewisite-1, lewisite-2 and lewisite 3.

8. The process of claim 1 wherein said oxidizing step comprises exposing said chemical agent hydrolysate to an oxidant selected from the group consisting of hydrogen peroxide, ozone, sodium persulfate, sodium meta-periodate and combinations of two or more of these.

9. A process for the treatment of chemical agent hydrolysates comprising:

(a) introducing a radiation excitable oxidant into a chemical agent hydrolysate;

(b) exposing said oxidant and said chemical agent hydrolysate to radiation in an amount and for a time effective to oxidize at least a portion of said chemical agent hydrolysate and to produce an oxidized chemical agent hydrolysate containing organic compounds; and (c) removing from said oxidized chemical agent hydrolysate at least a portion of the organic compounds present therein by exposing said oxidized chemical agent hydrolysate to biodegradation.

10. A process for the treatment of energetic hydrolysates in accordance with claim 9, said process further comprising combining at least a portion of said oxidized chemical agent hydrolysate and at least a portion of energetic hydrolysate to form a combined hydrolysate, and wherein said removing step (c) comprises removing from said combined hydrolysate at least a portion of the organic compounds present in said combined hydrolysate.

11. The process of claim 9 further comprising the step of diluting said chemical agent hydrolysate or said oxidized chemical agent hydrolysate with a solvent.

12. The process of claim 9 wherein said removing step comprises biologically treating said oxidized chemical agent hydrolysate in an immobilized cell reactor.

13. The process of claim 12 wherein said biological treating step produces an effluent and wherein said process further comprises clarifying said effluent to produce a clear effluent stream suitable for evaporation.

14. The process of claim 13 wherein said biological treating step produces an aqueous waste stream and wherein said process further comprises clarifying said aqueous waste stream to remove at least a portion of any biological solids contained therein and to produce a clear effluent stream suitable for evaporation.

15. The process of claim 12 wherein said step of biologically treating said oxidized chemical agent hydrolysate produces a gaseous product, and wherein said process further comprises catalytically treating said gaseous product.

16. The process of claim 15 wherein said biological treating step further comprises the steps of i) adjusting the pH of at least a portion of said oxidized chemical agent hydrolysate to a pH of from about 6 to about 9;

ii) adding to at least a portion of said oxidized chemical agent hydrolysate additional supplements to support microbial growth;

iii) diluting at least a portion of the oxidized chemical agent hydrolysate with water in an amount effective to support microbial growth; and iv) catalytically oxidizing at least a portion of the gaseous products created during said biological treatment step to remove volatile organic compounds.

17. The process of claim 12 wherein said biological treatment step comprises introducing the oxidized chemical agent hydrolysate into a bio-reactor and/or conditions effective to produce a molar hydraulic residence time of about 4 to about 6 days.

18. A process for the demilitarization of chemical munitions containing at least one chemical agent and at least one energetic agent comprising:

(a) neutralizing said chemical agent by hydrolysis to produce chemical agent hydrolysate;

(b) neutralizing said energetic agent by hydrolysis to produce aqueous energetic agent hydrolysate;

(c) oxidizing said chemical agent hydrolysate by exposing the chemical agent hydrolysate to an oxidant and to UV radiation to produce a treated chemical agent hydrolysate;

(d) biologically degrading said treated chemical agent hydrolysate to remove at least a portion of organics present therein; and (e) removing from said aqueous energetic agent hydrolysate at least a portion of organics present therein.

19. The process of claim 18 wherein said step of removing organics from said aquerus energetic agent hydrosylate comprises biologically degrading said aquerus energetic agent hydrolysate.

20. The process of claim 19 wherein at least a portion of the step of biologically degrading said energetic aquerus agent hydrolysate is conducted substantially simultaneously with at least a portion of said step of biologically degrading said treated chemical agent hydrolysate.

21. The process of claim 18 wherein said biological degradation step (d) produces gases that comprise organic compounds and wherein the process further comprises removing such organic compounds from said gases by catalytic oxidation.

22. The process of claim 18 wherein said neutralization step (a) comprises diluting the chemical agent hydrolysate with water.

23. The process of claim 18 wherein said chemical agent hydrolysate comprises alkyl phosphonates and where the molar ratio of said oxidant to said alkyl phosphonates in said step (c) is from about 5:1 to about 1:1.

24. The process of claim 18 wherein said step of exposing the chemical agent hydrolysate to an oxidant comprises adding an oxidant to said chemical agent hydrolysate to form an oxidant/hydrolysate mixture and wherein said step of exposing said chemical agent hydrolysate to radiation comprises irradiating said mixture with UV light having a wave length of from about 190 nm to about 390 nm.

* * * * *